United States Patent [19]

Cramer

[11] Patent Number: 4,585,040

[45] Date of Patent: Apr. 29, 1986

[54] METHOD AND APPARATUS FOR DISPENSING PRODUCT UPON SUBJACENT OBJECTS

[75] Inventor: Clarence W. Cramer, Burlington, N.J.

[73] Assignee: Campbell Soup Company, Camden, N.J.

[21] Appl. No.: 697,782

[22] Filed: Feb. 4, 1985

[51] Int. Cl.[4] ..... B65B 3/04

[52] U.S. Cl. ..... 141/137; 141/183; 141/283; 141/280; 141/270; 141/248

[58] Field of Search ..... 141/129, 178, 135, 137, 141/138, 163, 183–186, 250, 256, 259, 275, 280, 283, 284, 234–248, 270, 1, 90, 125

[56] References Cited

U.S. PATENT DOCUMENTS

| | | | |
|---|---|---|---|
| 2,333,232 | 11/1943 | Bleam et al. | 141/183 X |
| 2,443,182 | 6/1948 | Carter | 141/183 X |
| 2,663,478 | 12/1953 | Jahn et al. | 141/137 |
| 3,362,441 | 1/1968 | Williams et al. | 141/137 |
| 3,605,645 | 9/1971 | Henmann | 141/137 X |
| 3,762,451 | 10/1973 | Anderson | 141/186 |
| 4,375,826 | 3/1983 | Stohlquist et al. | 141/137 |
| 4,398,577 | 8/1983 | Sauer | 141/135 |

FOREIGN PATENT DOCUMENTS

| | | | |
|---|---|---|---|
| 2119266 | 11/1972 | Fed. Rep. of Germany | 141/137 |

OTHER PUBLICATIONS

Campbell Soup Co. Drawing 73ERD 17-A2-6 "Blueprint of Drive Mechanism".

*Primary Examiner*—Stephen Marcus
*Assistant Examiner*—Ernest G. Cusick
*Attorney, Agent, or Firm*—Albert L. Free

[57] ABSTRACT

Apparatus for dispensing uncompacted rice upon each of a continuously-moving train of plates from a hopper containing an auger which is rotated to effect dispensing only when a plate is in position beneath the outlet of the hopper. The hopper is caused to swing back and forth about an axis at right angles to the direction of motion of the plates, so that the outlet of the hopper swings downstream at about the same speed as the underlying plate while the auger is operating, thereby to concentrate the dispensed rice on a predetermined part of the plate. The timing may be such that, while the hopper is executing its upstream return motion, the next plate passes beneath it without receiving rice, the hopper dispensing only upon every other plate; another similar hopper at a downstream position then provides similar rice deposits upon similar parts of those alternate plates which do not receive rice from the upstream hopper. A wiper arm preferably wipes the hopper outlet clean of rice at the end of each dispensing operation.

12 Claims, 15 Drawing Figures

4
3
104
102
105
3
44A
44
40
110
A
A'
112
39
106
108
98
46
10
12
60
7
8
7
52
100
18
8
21
50
34
30
160
86
32
162
56
33
80
92
94
4

METHOD AND APPARATUS FOR DISPENSING PRODUCT UPON SUBJACENT OBJECTS

BACKGROUND OF THE INVENTION

There are a variety of applications in which it is desired to dispense flowable product upon subjacent objects. As an example only, with respect to which the invention will be described with particular reference, it is often desired to dispense food products upon food receptacles, for example to dispense rice upon a dish or tray which is to carry a frozen-food type of dinner.

In general, it is desirable to be able to dispense the product upon a predetermined portion of the subjacent object, for example to dispense a particular type of food upon a particular area of a food tray. One way in which this has been done is to load a large hopper with the flowable food product, move the tray or receptacle into a stationary position beneath the hopper, and then rotate a dispensing auger at the outlet end of the hopper sufficiently to dispense the desired amount of food product upon the underlying position of the tray. This suffers from the drawback that the tray motion is intermittent, which is very inefficient in high-speed production processes. Instead, it is desirable to be able to dispense the product as the subjacent object is continuously moving beneath the dispenser.

One way in which such dispensing has been performed in the past utilizes a dispensing line extending from the lower end of the hopper and which contains a metering piston and chamber for dispensing a predetermined amount of the product from the outlet end of the line each time the piston is advanced, and for pulling additional product into the dispensing chamber during withdrawal of the piston. The outlet end of the dispensing line is then moved cyclically back and forth over and along the direction of motion of the receptacle, the piston being actuated to dispense product only while the receptacle is beneath the outlet end of the dispensing line. While satisfactory for some purposes in that the outlet end of the tube leading from the piston chamber can be caused to move with and above the receptacle to a limited extent during dispensing, in many cases it has been found that such use of a piston for dispensing the product often produces unacceptable results.

In some measure this is due to the complexity of the system, and to the typical relatively small motion of the dispensing end of the dispensing line along the path of the receptacles; however, in other cases, its principal drawback is with respect to its effect upon the product. For example, in many instances it is preferred that cooked rice dispensed onto the receptacles have a relatively light, fluffy, non-compacted form, as determined by consumer preferences. The piston dispenser tends to compact the product which it is moving, and in the case of rice of certain types, cooked to particular stages, the dispensed product may be too tightly agglomerated and compacted. This same drawback, due to the compacting effect of the piston dispenser, can affect adversely the dispensing of other products as well.

Accordingly, it is an object of the present invention to provide a new and useful method and apparatus for the dispensing of flowable food products upon a moving object.

Another object is to provide such method and apparatus in which the food product is not subjected to the compacting effects of a piston.

Another object is to provide such method and system which is simple and reliable in construction and operation, and which is readily adjustable to provide different consistencies and distributions of dispensed product.

SUMMARY OF THE INVENTION

These and other objects and features of the invention are achieved by the provision of method and apparatus comprising a hopper for receiving and storing the product to be dispensed and having an exit passage at its lower end, which hopper is oscillated angularly back and forth generally along the direction of motion of the subjacent moving objects, and an auger in the hopper which is momentarily and intermittently operated to dispense the product upon the moving objects in the positions desired, and not elsewhere.

To this end, the hopper is preferably pivotted around an axis near its upper end, and drive means are connected to the hopper at a lower point, preferably near the exit passage, to cause the lower end of the hopper to swing back and forth with the above-described oscillatory motion. The apparatus preferably also comprises an arrangement in which the auger-driving motor is mounted to the hopper to oscillate with it; an agitator is preferably also provided within the hopper to continuously mix the product, the agitator preferably being driven by an agitator motor mounted to the hopper so as to move with the hopper.

In the preferred embodiment there is also provided a wiper blade means, rotatably mounted adjacent the exit orifice of the hopper outlet passage, which is rotatable to sweep across the exit orifice so as to clean product from the orifice at the end of each dispensing cycle. Preferably the wiping action is provided by an arm which, during the wiping, moves across the orifice generally counter to the direction of movement of the receptacle outlet, and which returns to its original position during the immediately following time when the hopper is not dispensing product.

BRIEF DESCRIPTION OF DRAWINGS

These and other objects and features of the invention will be more readily understood from a consideration of the following detailed description, taken in connection with the accompanying drawings, in which.

DETAILED DESCRIPTION OF SPECIFIC EMBODIMENTS

Figure 1:
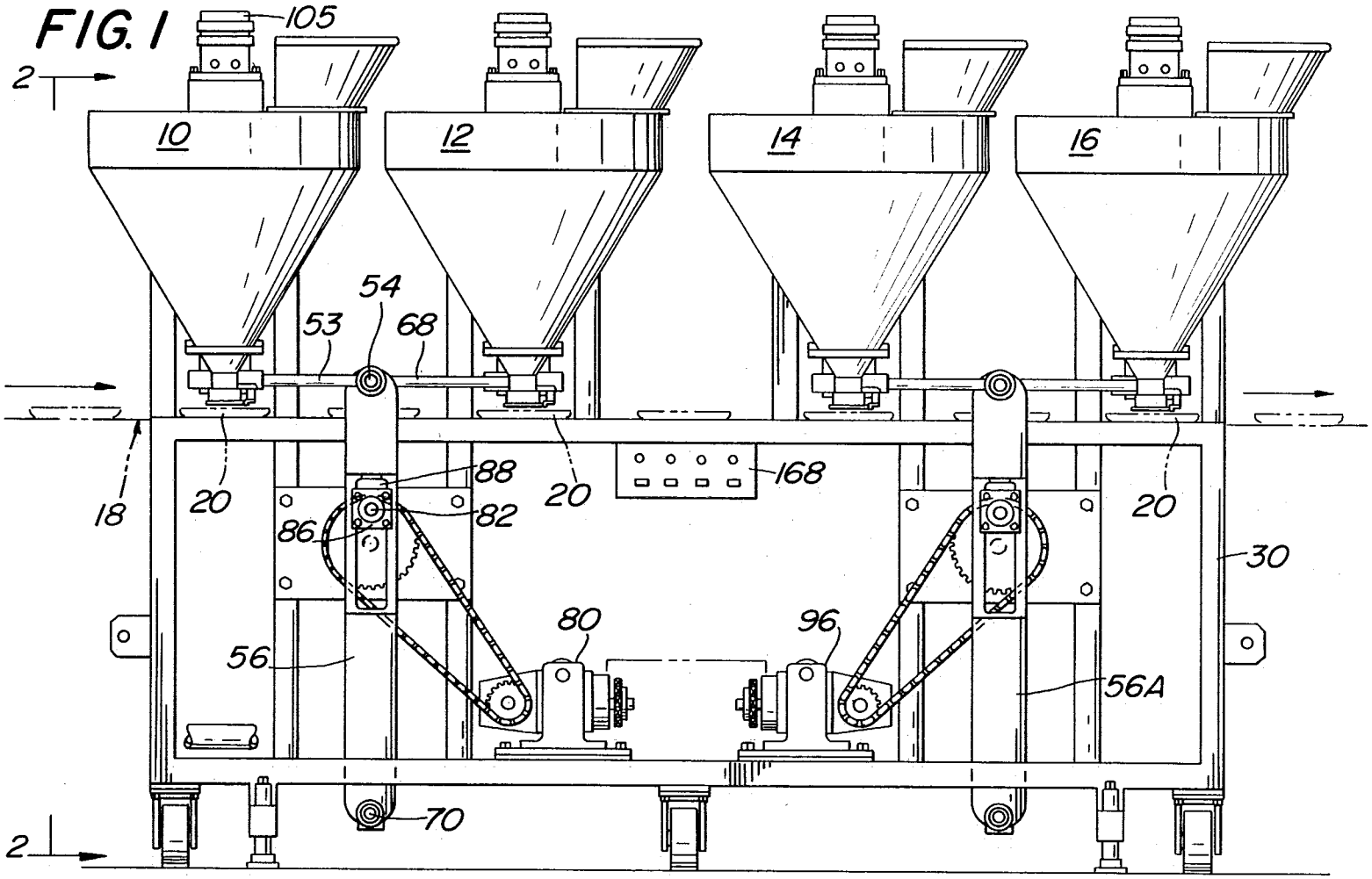
FIG. 1 is a side elevational view of a preferred embodiment of the subject invention.

Considering now the specific embodiments of the invention illustrated in the drawings by way of example only, there are shown four generally conical dispensing hoppers 10, 12, 14 and 16 disposed along a conventional chain-driven conveyor 18, shown schematically, on which two trains of plates or trays such as 20 are moved along in predetermined positions on platens such as 21, beneath the lower, dispensing ends of the hoppers. It will be assumed in this application of the invention that the purpose of the apparatus is to dispense rice from each of the hoppers upon corresponding plates passing beneath them at relatively high speeds, without dispensing rice upon the rims of the plates or between the plates, and while confining the rice to predetermined portions of the plates. As will become more apparent from the other figures and the description later herein, each of the hoppers is caused to oscillate angularly back and forth along the path of the plates, and an auger mechanism is actuated to dispense the rice while the lower end of each hopper is moving forwardly along the direction of motion of the plate passing beneath the discharge end of the hopper.

Figure 12A:
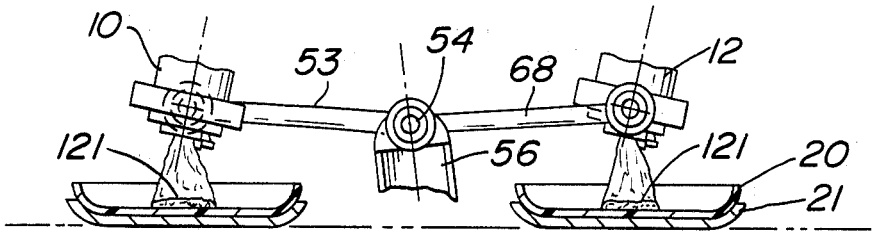
FIGS. 12A, 12B and 12C are side elevational views of the two upstream hoppers in three respectively different angular positions.
Figure 12B:
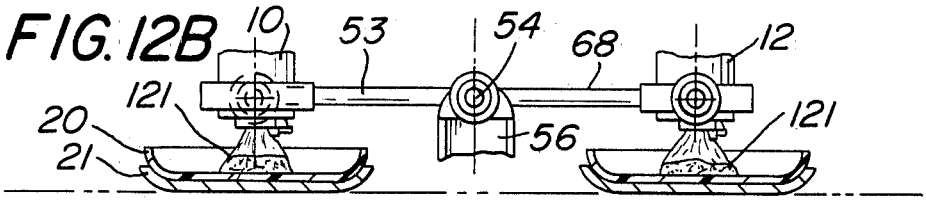
Figure 12C:
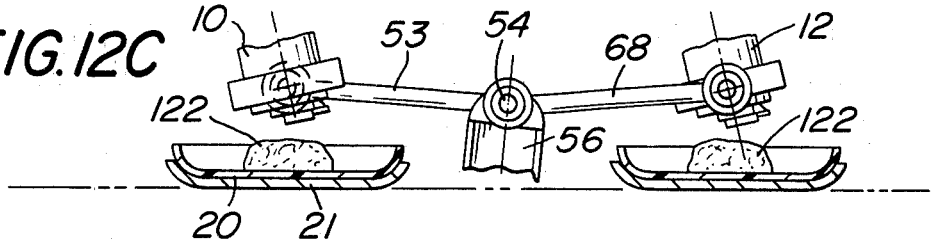

The latter operation is depicted schematically in FIGS. 12A, 12B and 12C, which show hoppers 10 and 12 in three successive positions of their oscillatory motion, during that half of the cycle in which the lower ends of the hoppers are moving along the direction of motion of the plates 20 to produce piles of rice on limited portions of the plates. The dispensing occurs only during the portions of the forward swings of the hoppers shown in these figures, the flow of rice being turned off at the extremes of the swings and during return swings counter to the direction of travel of the plates. In this way the dispensing of the rice is caused to occur only on a preselected portion of each plate. The apparatus now to be described in detail illustrates a preferred embodiment of a system for accomplishing this overall operation.

Referring again to FIG. 1, in the preferred embodiment of the invention the four hoppers are not longitudinally in line with each other, but instead are alternately staggered laterally with respect to the conveyor line, and two lines or trains of plates are passed beneath them on the conveyor. Two such lines of plates are shown, for example, in FIG. 7, which also shows the positions of hoppers 10 and 12 with respect to these trains of plates, i.e. hopper 10 is positioned above the path of the right-hand lane of plates and hopper 12 is above the left-hand lane of plates. Thus in FIG. 1 hoppers 10 and 14 are nearer to the viewer and 12 and 16 are somewhat more remote.

However, hoppers 10 and 12 and all of the associated apparatus for operating them and conveying the plates beneath them are identical to hoppers 14 and 16 and their associated apparatus and conveying system. Since these two pairs of hoppers are identical with each other, in the interest of simplicity and clarity the remaining drawings and description will primarily show and describe only hoppers 10 and 12 and their associated apparatus, it being understood that in the preferred embodiment of FIG. 1 this apparatus is duplicated for hoppers 14 and 16, further downstream with respect to the direction of motion of the plates. The invention is in fact applicable to use of a single hopper for a single line of plates, provided that the plates are far enough apart to permit the hopper to complete its reverse, upstream swing before the next plate moves into position beneath it. However, the preferred embodiment shown in FIG. 1 uses an arrangement in which the upstream hoppers 10 and 12 dispense only upon every other alternate plate, while the respective downstream hoppers 14 and 16 dispense upon the intervening alternate plates not dispensed upon by hoppers 10 and 12. This permits the plates to be closely positioned along the lines, with every plate nevertheless receiving its appropriate deposit of rice.

Figure 2:
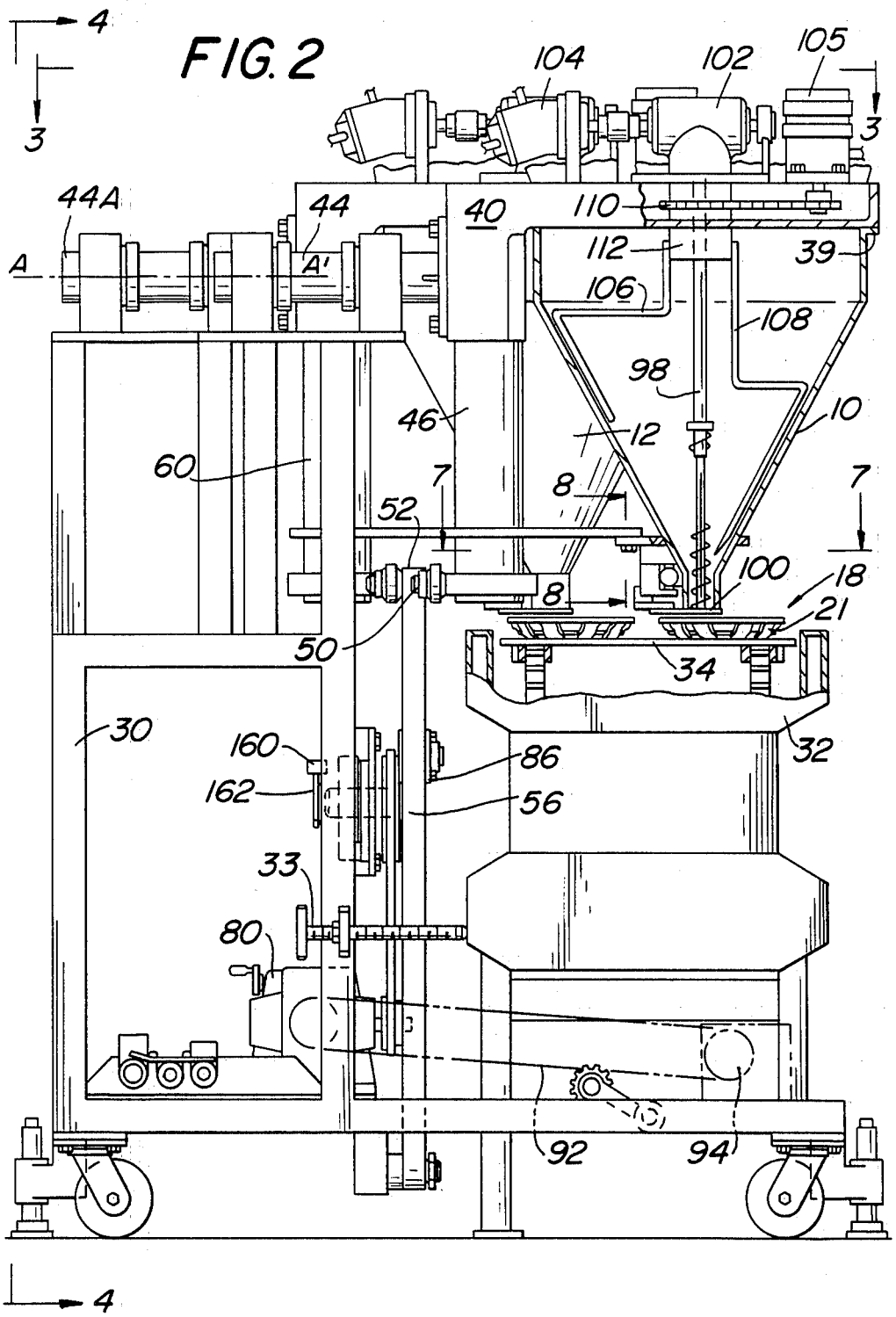
FIG. 2 is an end view of the apparatus of FIG. 1, taken along lines 2—2 of FIG. 1.

Also, in order to see the apparatus more clearly in FIG. 1, the conveyor mechanism, which may be entirely conventional, is not shown, although the conveyor is depicted in FIG. 2 in the position which it occupies during normal operation.

Figure 7:
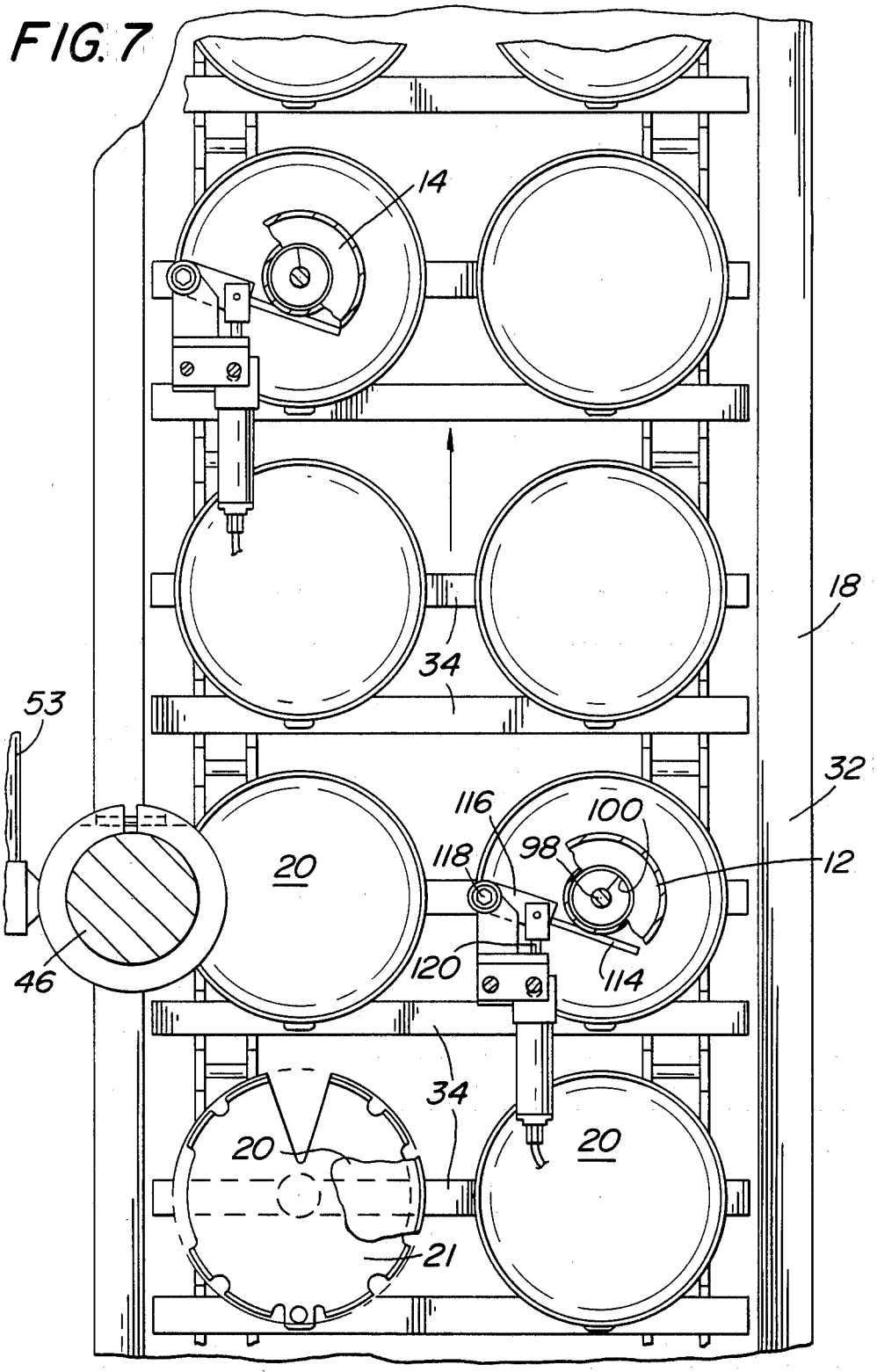
FIG. 7 is a fragmentary sectional plan view taken along lines 7—7 of FIG. 2.

The hoppers and dispensing apparatus are mounted on a common frame 30, while the conveyor is mounted on a separate frame 32, which can be moved into position as desired beneath the hoppers, with its exact lateral position adjusted and controlled by positioning screws such as 33 (FIG. 2). As can be seen in FIGS. 2 and 7, each plate is securely positioned within a corresponding pallet such as 21 which in turn is fixed in known position to a crossbar 34 on the conveyor 18.

Figure 3:
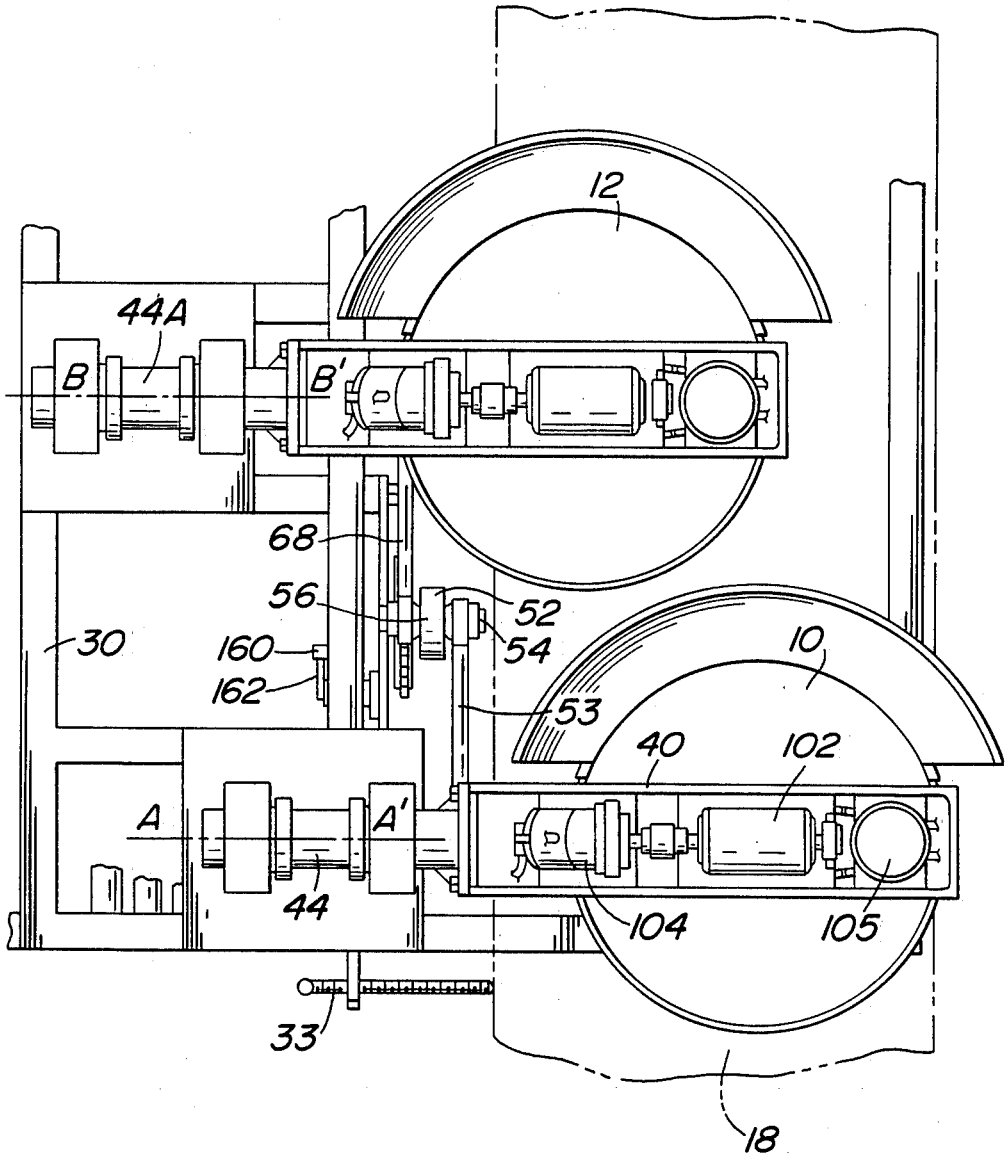
FIG. 3 is a plan view of the apparatus of FIG. 1, taken along lines 3—3 of FIG. 2.

Referring now especially to FIGS. 2 and 3, hopper 10 is pivotally mounted to swing back and forth about axis AA', while hopper 12 is pivotted to swing back and forth about BB'. To accomplish this, hopper 10 is secured by a flange 39 to an L-shaped beam 40 mounted to a hopper mounting shaft 44. Since hoppers 10 and 12 and their mounting arrangements may be identical, only hopper 10 and its mounting arrangement will be described in detail. A post 46 extends downwardly from the vertical portion of beam 40, and a pivot pin 50 extends generally horizontally from the lower end of post 46. Pin 50 engages and mates with a yoke 52 at the end of a connecting rod 53, the other end of which is pivotally secured to a pivot 54 at the end of oscillating beam 56. Pin 58 on the vertical post 60 of the other hopper assembly 12 is also connected to pivot pin 54 by way of a connecting rod 68.

Oscillating beam 56 is mounted on, and angularly oscillatable about, a pivot pin 70 near its bottom end, so as to move back and forth between the extreme angular positions marked by lines 72 and 74. This oscillating motion of beam 56 acts through connecting rods 53 and 68 to produce a corresponding swinging motion of the two hoppers 10 and 12 about the hopper shafts 44,44A in FIG. 4. It will be understood that a synchronous swinging of the hoppers 14 and 16 about their respective pivots is also provided by a similar oscillating motion of beam 56A (FIG. 1).

Figure 4:
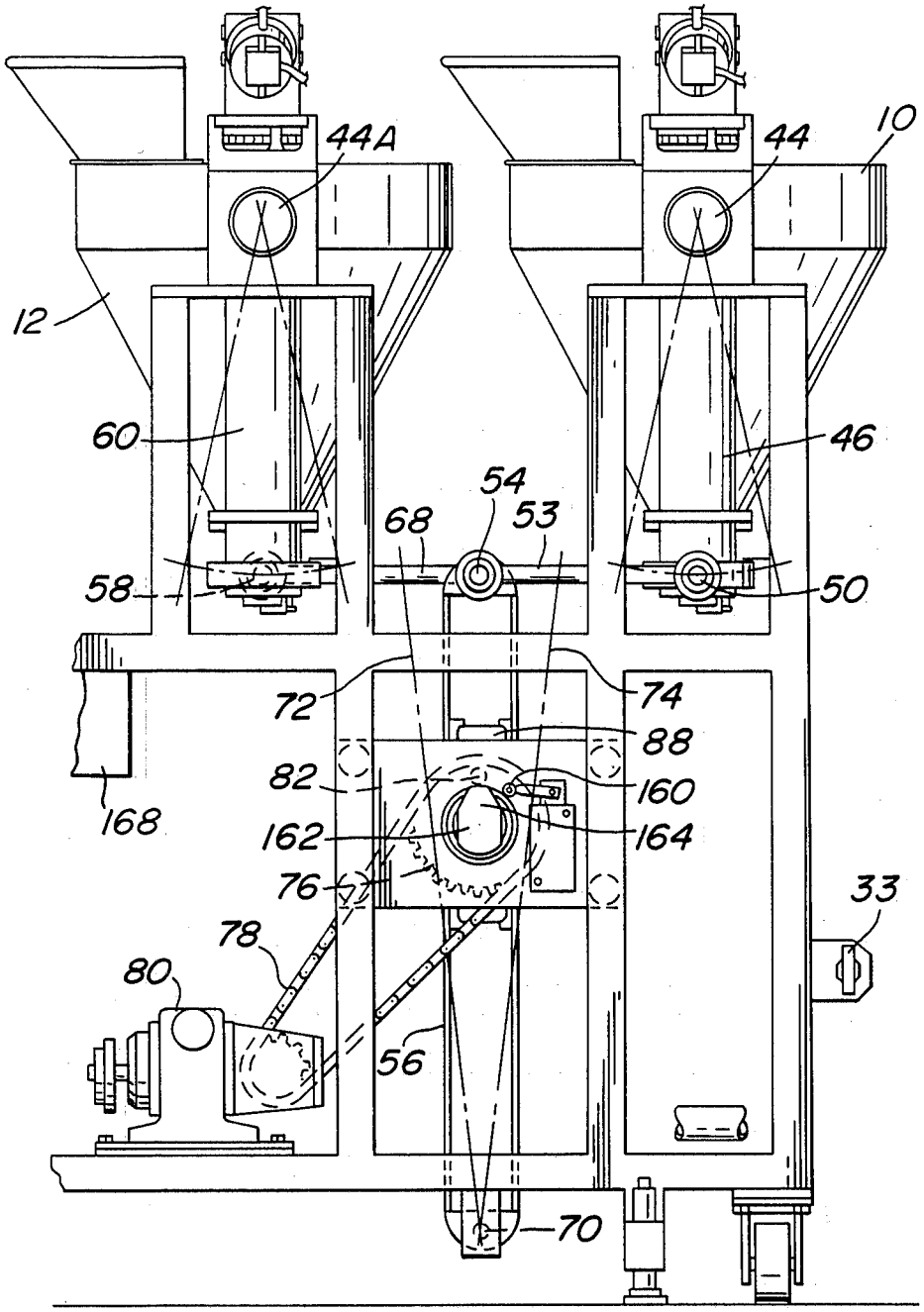
FIG. 4 is a more detailed side elevational view of one-half of the apparatus of FIG. 1.
Figure 5:
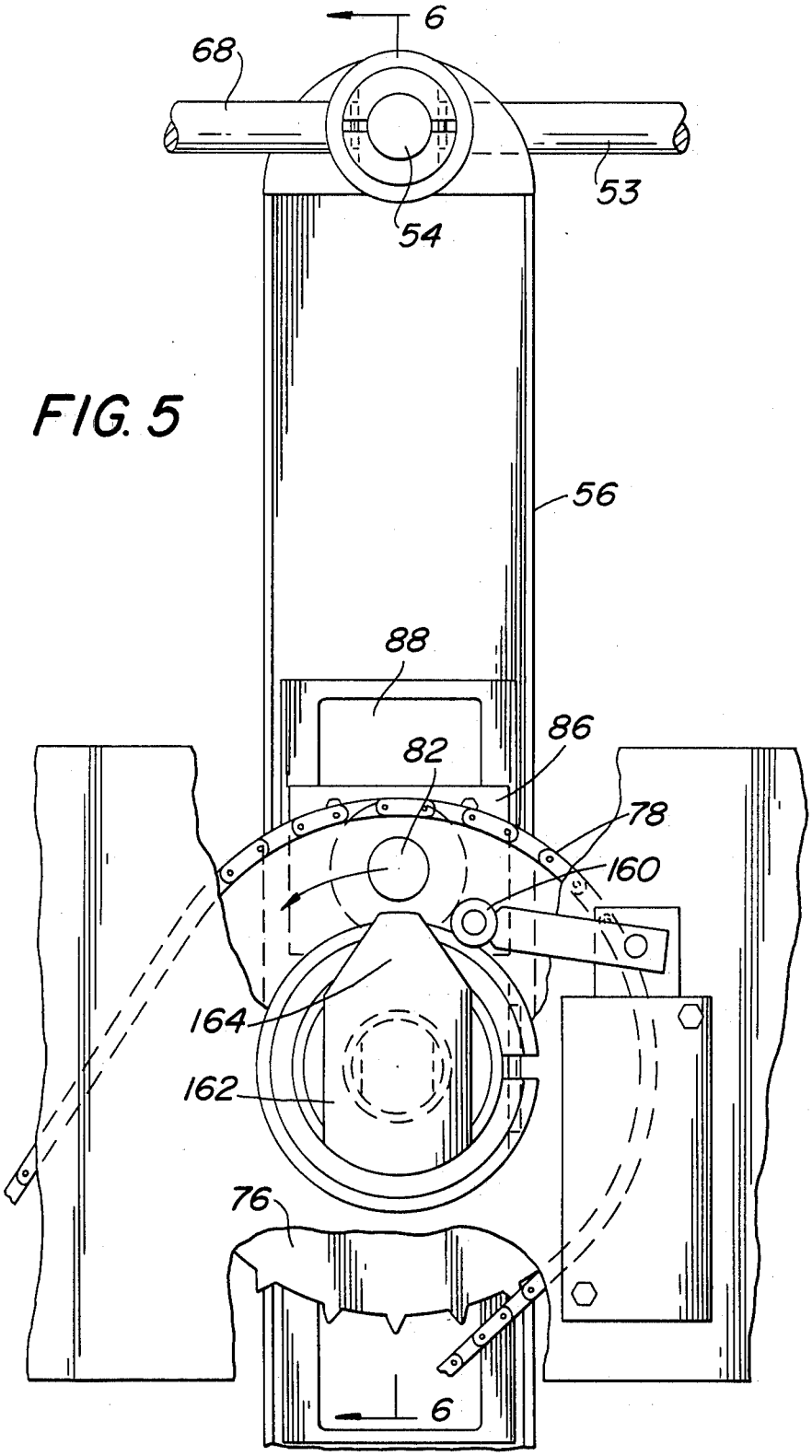
FIG. 5 is an enlarged fragmentary elevational view of a portion of FIG. 4, showing in more detail the mechanism for oscillating the hoppers.
Figure 6:
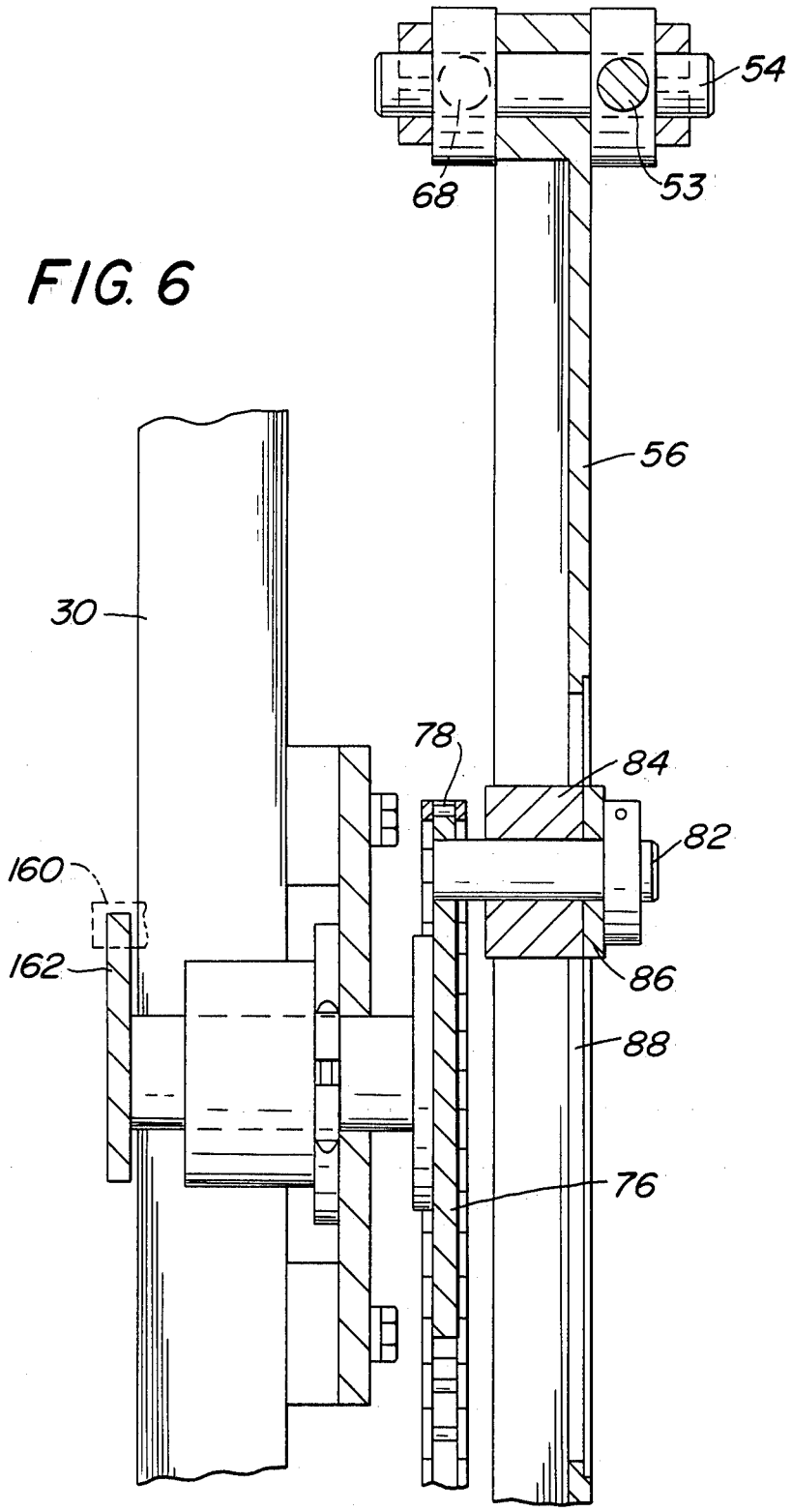
FIG. 6 is a fragmentary vertical sectional view taken along lines 6—6 of FIG. 5.

The particular preferred mechanism for providing the oscillating motion of beam 56, and for the other beam 56A for the other pair of hoppers, is shown especially clearly in FIG. 4 taken in connection with FIGS. 5 and 6. A sprocket wheel 76 is driven by a chain 78 from a phase-and-frequency control unit 80 so as to rotate counterclockwise as viewed in FIGS. 4 and 5. An eccentric pin 82 fixed to sprocket wheel 76 at a position off-center from its axis of rotation extends parallel to the axis of rotation of the sprocket wheel so as to engage in a cylindrical sleeve 84 mounted in a slidable block 86, which block is in turn slideably mounted in a rectangular opening 88 in beam 56 so as to be able to slide vertically in the beam. Accordingly, as eccentric pin 82 rotates counterclockwise from the initial position shown in the drawings, the beam 56 will pivot angularly to the left in response to the driving force exerted by pin 82, while the block 86 slides downwardly in opening 88 to accommodate the vertical component of motion of pin 82. Beam 56 achieves its maximum leftward position when the pin has moved by about 90° from the position shown; it returns to its original position when the pin has moved by 180°, moves to its maximum rightward position when the pin is at about 270°, and returns to its initial position when the pin has completed 360° of motion. It will be understood that during such oscillating motion of the beam, the connecting rods 53 and 68 pivot appropriately about the pivots provided at each of their ends, so as to accommodate the angular motion of the beam and to provide the desired swinging motion of the two hoppers associated with the connecting rods as shown in FIGS. 12A, 12B and 12C.

It will be noted that when the pin 82 is rotating near the position shown in FIG. 4, it is further from the lower pivot pin 70 than when it is rotating near its lowest position, and accordingly the motion of the hopper is somewhat slower during the dispensing swings than during the return swings in the upstream direction.

The extent of angular motion of the hoppers depends upon the distance of the eccentric pin from the axis of rotation of sprocket wheel 76, and can be selected to provide the desired angular degree of swinging of the hoppers. The speed and phase of the swinging of the hoppers 10 and 12 is controlled by the speed and phase established by the unit 80, which is selected and adjusted to provide the desired relation of the motion of the hoppers with respect to the motion of the plates passing under them. The desired synchronization of the swinging motion of the hoppers 10 and 12 with the position of the plates is made possible by means of a chain 92 extending from the main conveyor line shaft 94 to the phase and frequency synchronizing unit 80, which also serves the function of providing a right angle change of direction of the drive. Another phase and frequency synchronizing unit 96 controls the swinging motion of the downstream pair of hoppers 14 and 16, the phase of which can therefore be, and in this example is, different from that of the upstream hoppers 10 and 12.

Each of the hoppers 10–16 is provided with an auger such as 98, as shown in FIG. 2. The auger may be a commercially available auger having flights at its bottom end, as well as a few flights near its center, the bottom flights serving directly to meter a certain amount of the contents of the hopper outwardly through the discharge opening 100 of the hopper, the amount depending on the number of turns made by the auger during each passage of a plate beneath it; the upper flights provide a general downward motion of the material in the hopper. The auger 98 is mounted from and driven by a right angle drive unit 102, mounted on beam 40, and rotational energy for driving the auger is provided from hydraulic motor 104 by way of drive unit 102. The arrangement for controlling the times of operation of the auger will be described later herein. Another hydraulic motor 105, also mounted on beam 40, provides rotational energy to drive a pair of agitator rods 106 and 108 by way of a belt 110 and a drive cylinder 112 to which the rods are secured. The latter agitating arrangement may also be conventional.

Figure 8:
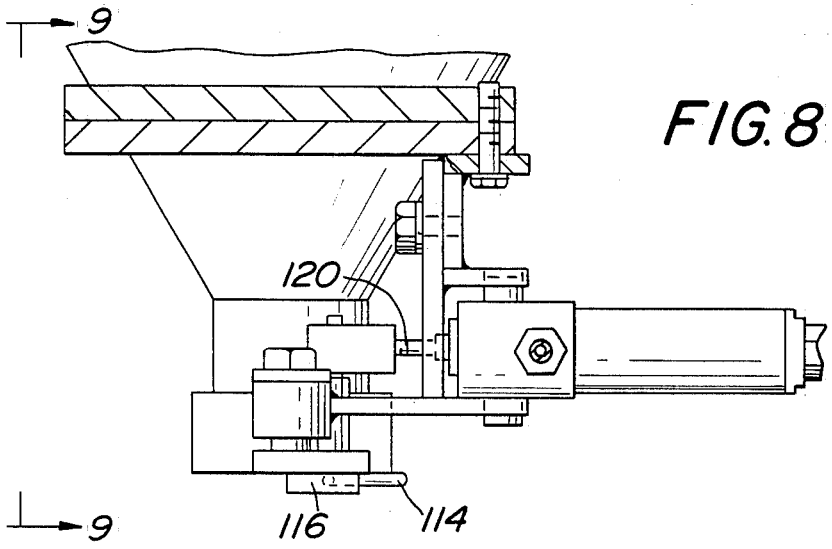
FIG. 8 is an enlarged elevation fragmentary view of the wiper system used at the bottom of each hopper.
Figure 9:
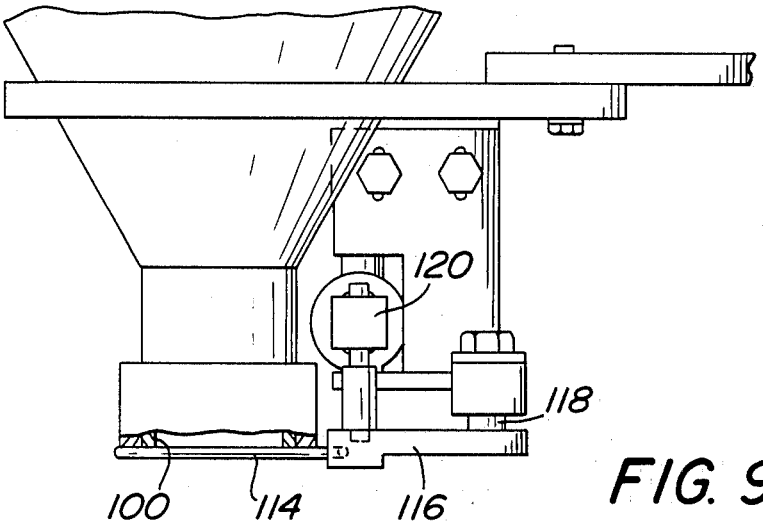
FIG. 9 is an end view of the apparatus of FIG. 8, taken along lines 9—9.

FIGS. 7, 8 and 9 show a wiper arrangement which is preferably used at the discharge opening 100 of each of the hoppers, whereby an arm 114 is caused to sweep across the discharge opening and back again, immediately upon cessation of the operation of the auger in discharging product from the hopper, thereby to positively wipe the discharge opening free of product and to prevent any dropping of the product between the positions where it is intended to be deposited. The arm 114 is in the form of a cylindrical rod mounted to a blade 116 which is in turn pivotted about a pivot 118 mounted to the lower end of the hopper. A pneumatically operated piston rod 120 is secured at its forward end to the blade 116, at a distance from the axis of pivot of the blade; when the latter piston is retracted, the blade 116 assumes its rest position in which it is adjacent but beyond the periphery of the discharge opening, while when the piston is advanced the wiper arm 114 sweeps across the discharge opening. The piston can be double-acting so to be driven in both directions, and spring-biased toward the rest position shown, so that it is driven by pneumatic pressure in its sweep across the discharge opening, against the force of the spring.

The structure of the system having been described, the synchronization of its operation will now be set forth.

FIGS. 12A, 12B and 12C illustrate the type of synchronization of each hopper with the underlying plates which is desired for the present purpose of depositing the product, such as rice, upon a predetermined limited area of the plate as it passes beneath the hopper without stopping. FIG. 12A shows the hoppers such as 10,12 pivotted in an upstream direction, in which positions they begin the dispensing of the rice 121 upon the plate; FIG. 12B shows the slightly later position in which the hoppers are vertical and are still dispensing rice, resulting in the accumulation of slightly greater quantities of rice on the plates as shown; and FIG. 12C shows the hoppers at more forward positions, when dispensing has just been cut off, and the desired accumulations of rice have been provided on the plates at 122, with no more rice dispensed until the second-next plate arrives in the position shown in FIG. 12A. Typically the dispensing is for only about one-half of the forward swing of the hoppers, e.g. for about 3 inches of a 6-inch forward swing of the hopper.

As previously mentioned, this synchronization between the positions of the plates and the angular positions of the hoppers is provided by first ensuring a predetermined position of each plate by supporting it in a known position on a platen fixed to a chain-driven conveyor, and by synchronizing the oscillatory swinging motion of the hoppers with the main line drive for the conveyor.

As also mentioned previously, it is possible to utilize only one hopper for each line to accomplish a useful dispensing operation, and in the type of embodiment shown this would typically be done by omitting every other plate, since the dispenser would not dispense upon these plates; that is, although each hopper dispenses during at least a portion of the time when it is moving forwardly along with its underlying plate, during the return motion of the hopper the dispensing is cut off, and the next plate passes below the dispenser without receiving any product. If such an arrangement is used, alternate plates are omitted from the conveyor. However, it is preferred, as shown in FIG. 1, to use two hoppers per line of plates, with one hopper of each line dispensing upon every alternate plate and the other hopper in that line dispensing upon the intervening plates upon which the first one does not dispense.

Figure 13:
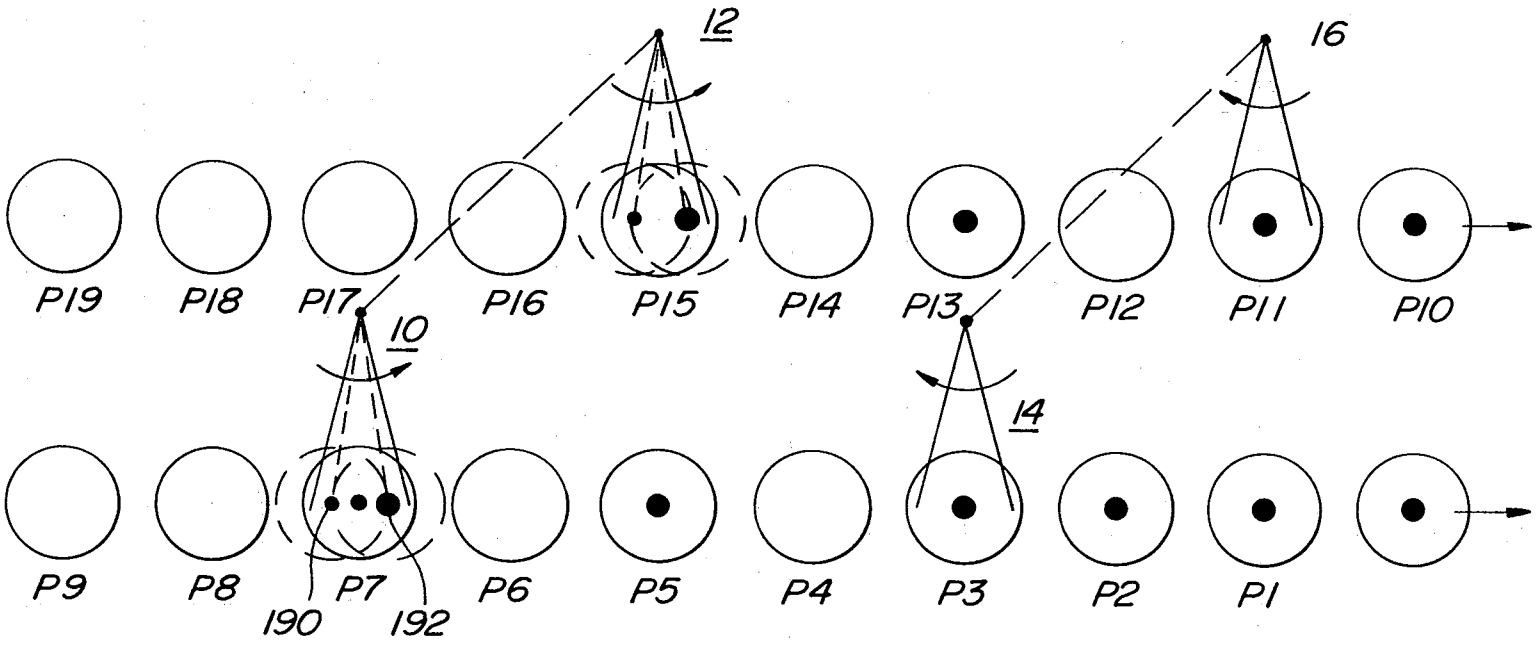
FIG. 13 is a schematic view of a conveyor line illustrating timing relations for the operations of the hoppers.

This is illustrated in highly schematic form in FIG. 13, wherein the plates $P_1$ through $P_9$ for one line are shown in a fixed position, and plates $P_{10}$ through $P_{19}$ are shown for the other line. The locations and angular positions of the four hoppers are represented by the divergent lines at the hopper locations 10, 12, 14 and 16. The solid lines represent the extremes of the swings of the hoppers, the broken lines represent the extreme of the angles at which rice is dispensed, and the curved arrows show the directions of swinging of the hoppers at the times shown. The broken circles in the drawing represent the positions of those plates which are shown in solid line directly below the hoppers $P_3$, $P_9$, $P_{11}$ and $P_{15}$, just prior to and just after the time depicted in solid line. For example, with regard to $P_7$ the upstream broken circle represents the position of the plate $P_7$ when the hopper has swung to its maximum upstream position, has started forwardly, and has begun to dispense the small amount of rice shown at 190; the solid line position of $P_7$ is that for which the hopper has moved to its vertical position, at which time it has dispensed more rice; the downstream broken-line circles represents plate $P_7$ when it has advanced slightly further along the line, to the position where the hopper has swung further forwardly and dispensing has just been cutoff, leaving the desired amount of rice shown at 192. This same action and form of representation is depicted in connection with the other hoppers 12, 14 and 16.

Referring to the lower line of plates $P_1$ through $P_9$, which are shown moving to the right, it will be seen that the hopper 10 deposits the rice only on alternate plates such as $P_1$, $P_3$, $P_5$, $P_7$ and $P_9$; the intervening plates $P_2$, $P_4$, $P_6$ and $P_8$ are supplied with rice by the downstream dispenser 16 when it completes its upstream swing and moves forwardly in its dispensing swing. Thus, at the downstream outlet end of the conveyor line each plate has the desired rice deposit properly located upon it.

The other line comprising the plates $P_{10}$ through $P_{19}$ is exactly the same as the lower line of plates, except that the positions of the plates and the positions of the hoppers are displaced somewhat downstream from those depicted below them. This displacement is not fundamentally necessary, but is a convenience for the particular mechanisms utilized in the embodiment described. The mechanical linkages between hoppers 10 and 12, and between hoppers 14 and 16, are depicted by the heavy broken lines.

In operation then, each line is supplied with a series of plates located at predetermined known intervals, so that the position of each plate at any time is known; a hopper swinging angularly back and forth above the plates (and preferably two such hoppers for each line) is synchronized so that when the plates pass beneath the dispensing hopper the outlet end of the hopper moves downstream along with the plates and concentrates the dispensing upon a particular area of the plate; it is possible however, to provide some difference in relative velocity of the discharge end of the hopper and the plate, if one desires to provide some spreading out of the dispensed product.

The duration and times of occurrence of the intervals during which the product is dispensed are controlled by operating the augers such as 98 in each of the hoppers only during the times when dispensing is desired. In this embodiment, this means operating the hydraulic auger motor 104 only during such times. Although there are many ways in which the positions of the hoppers and/or of the conveyor can be sensed and used to control the time of dispensing, in this case such sensing is provided by a cam follower 160 moving along the exterior of the cam 162 mounted to rotate with the shaft on which the beam-oscillating sprocket wheel 76 is mounted.

The position of the cam ramp 164 in FIG. 4 is directly upward, the position for which the hoppers are vertical and in the middle of their dispensing action in this example. About 45° earlier in the rotation of the cam, the cam follower 160 is actuated by the cam ramp to supply a signal to control box 168, which contains appropriate electronics (not shown) to activate the solenoid valves for the auger motors to start turning of the augers for hoppers 10 and 12. A timer in the control unit (not shown) shuts off the auger motor at the end of the preselected desired dispensing interval. The same action occurs with respect to the cam followers and auger motors for the hoppers 14 and 16.

Figure 10:
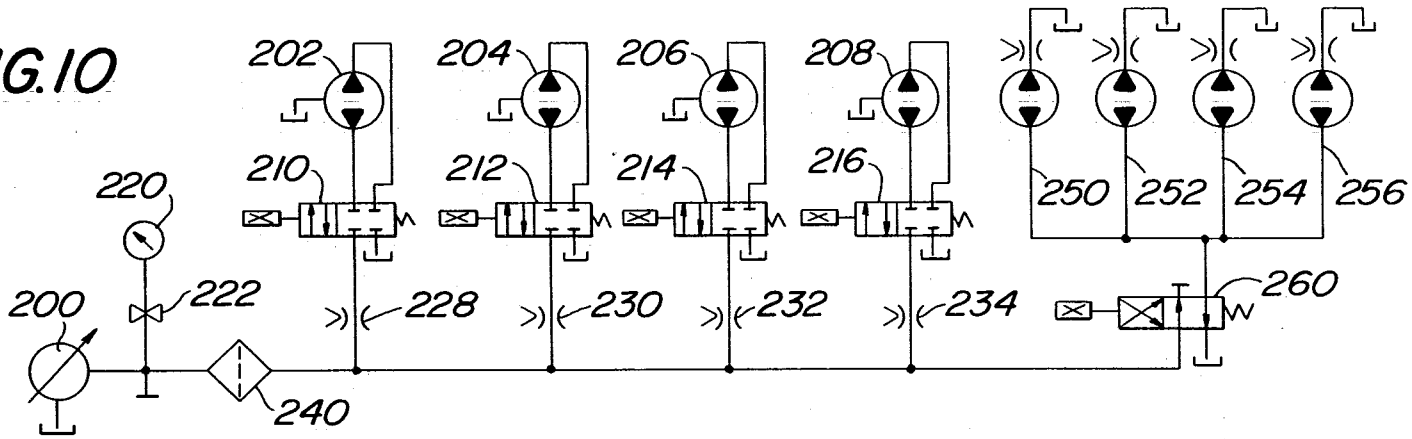
FIG. 10 is a schematic hydraulic diagram showing the hydraulic control system for operating the augers in the apparatus of FIG. 1.

FIG. 10 is a hydraulic control diagram of a hydraulic system which can be utilized to control the agitators and the dispensing augers for the four hoppers. A hydraulic pump unit 200 supplies hydraulic operating power to each of the four hydraulic auger operating motors 202, 204, 206 and 208 for hoppers 10, 12, 14 and 16, in each case by way of the respective solenoid-operated valves 210, 212, 214 and 216. An appropriate pressure gauge 220 and check valve 222, as well as flow adjusting valves 228, 230, 232 and 234, may also be provided, the latter permitting adjustment of the speeds of the motors. A suitable filter 240 is preferably also employed in series in the hydraulic line.

The four agitator motors 250, 252, 254 and 256 for the hoppers 10, 12, 14 and 16 are also supplied from the hydraulic pump unit 200, by way of a single solenoid-operated valve 260. This valve for the agitator motor is normally turned on continuously during operation, to maintain continuous agitation, while as described previously the solenoid valves for the auger motors are only turned on during those intervals when the respective solenoids are supplied with an appropriate valve-actuating current. The solenoid 260 is, however, preferably deactivated automatically should the conveyor-line motor cease operating. The auger-control solenoids are supplied with their actuating current from control box 168, which produces current during the time dispensing is desired in response to timing signals supplied from the cam follower 160 as described above.

Figure 11:
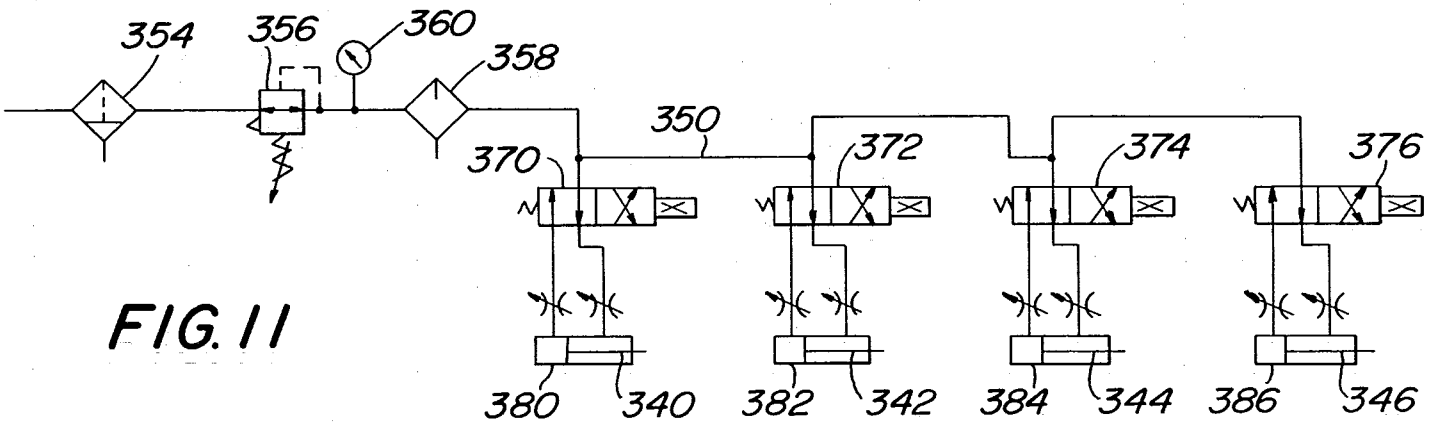
FIG. 11 is a schematic pneumatic diagram showing the pneumatic control system for operating the wiper assemblies in the apparatus of FIG. 1.

FIG. 11 shows the pneumatic diagram for the wipers. Each of the wipers 340, 342, 344 and 346 for the hoppers 10, 12, 14 and 16 is supplied with actuating pneumatic power by way of line 350 through a filter 354, a regulator 356, and a lubricator 358; a pressure gauge 360 is also provided. Each of the lines to and from the wiper actuator cylinders is provided with adjustable flow valves to permit appropriate adjustment. The solenoid valves 370, 372, 374 and 376, respectively, control the time of flow of actuating air to the air cylinders 380, 382, 384, 386 at the end of each dispensing cycle as controlled by control box 168.

The drawings show a system in which each line uses two hoppers dispensing upon alternate plates, but one can instead use any number n of hoppers per line each dispensing upon a different nth plate.

Thus while the invention has been described with particular reference to specific embodiments thereof in the interest of complete definiteness, it will be understood that it can be embodied in a variety of forms diverse from those specifically shown and described, without departing from the spirit and scope of the invention as defined by the appended claims.

What is claimed is:

1. Apparatus for providing a controlled flow of product onto a moving object, comprising:

a hopper for receiving and storing said product in flowable form, said hopper having an exit passage at its lower end;

means for maintaining said object in continuous motion in a predetermined direction along a path extending beneath said exit passage;

auger means in said passage rotatable to dispense product downward through said passage;

means for providing said hopper with an oscillatory angular motion about an axis transverse to said path so that said exit passage passes over said object while moving along the direction of motion of said object, during at least a portion of said oscillatory angular motion of said hopper; and motor means synchronized with said motion of said hopper for operating said auger means momentarily so as to dispense said product from said exit passage only while said passage is positioned substantially directly above, and moving along with, said object.

2. The apparatus of claim 1, wherein said hopper executes a plurality of cycles of said oscillatory motion, a first plurality of said objects are moved in sequence along said path, and said auger means is operated by said motor means intermittently and repetitively to dispense said product upon each of said objects as it passes beneath said exit passage.

3. The apparatus of claim 2, comprising means for moving along said path a second plurality of other objects alternating with said objects of said first plurality, wherein said hopper moves along and above said first plurality of objects and dispenses said product upon each of said first plurality of objects while they are moving, and moves in the opposite direction without dispensing said product when each of said second plurality of objects is passing beneath it, said apparatus also comprising a second hopper oscillating back and forth above said objects at a position spaced along the direction of motion of said objects from said first-named hopper for dispensing said product upon each of said second plurality of objects while said second hopper is swinging along said direction of motion above said each object of said second plurality.

4. The apparatus of claim 1, comprising agitator means in said hopper for mixing said product in said hopper.

5. The apparatus of claim 4, comprising motor means for driving said agitator means, secured to said hopper to move therewith.

6. The apparatus of claim 1, wherein said means for providing said hopper with an oscillatory motion comprises pivot means mounting said hopper for oscillatory motion along said path, and drive means connected to said hopper for oscillating it about said pivot means.

7. The apparatus of claim 6, wherein said drive means is operatively connected to said hopper at a point adjacent to said exit passage, to effect said oscillatory motion of said hopper.

8. The apparatus of claim 1, wherein said product is a food product, said object is a food receptacle, and said oscillating angular motion is directly along said path of said object.

9. The apparatus of claim 1, comprising wiper blade means mounted adjacent the exit orifice of said exit passage, and rotatable across said exit orifice to clean said product therefrom at the end of each dispensing of said product upon said object.

10. The apparatus of claim 1, wherein said motor means is mounted to said hopper to move therewith.

11. A system for depositing rice upon a predetermined portion of each of a train of plates moving along a conveyor, comprising:

a storage hopper for storing rice, and having a discharge opening at its lower end;

auger means in said hopper, rotatable to dispense rice through said discharge opening only when said auger means is rotating;

means for swinging said hopper about an axis normal to the direction of said train of plates so that said discharge opening moves alternately upstream and downstream above said train of plates; and means for rotating said auger means only when said discharge opening is moving downstream above said predetermined portion of one of said plates.

12. The system of claim 11, wherein the speed of said train and the speed of swinging of said hopper are such that two successive plates pass beneath said hopper for each complete cycle of swinging of said hopper and said hopper dispenses rice only on every alternate one of said plates said system also comprising:

a second hopper spaced along the direction of motion of said plates from said first-named hopper and having a second discharge opening at its lower end, means for swinging said second hopper about an axis normal to the direction of said train of plates so that said second discharge opening thereof moves alternately along and opposite to said direction of motion and above said train of plates, second auger means in said second hopper rotatable to dispense rice through said second discharge opening only when it is rotating, and means for rotating said auger means only when those of said plates between said alternate plates are passing beneath said second hopper thereby to dispense rice upon those plates not dispensed upon by said first-named hopper.

* * * * *